US008474062B2

(12) United States Patent
Taylor et al.

(10) Patent No.: US 8,474,062 B2
(45) Date of Patent: Jul. 2, 2013

(54) CALF AND ANKLE THERMAL PROTECTION DEVICE FOR MOTORCYCLISTS

(76) Inventors: Linda Marie Taylor, Louisville, KY (US); Beverly Louise Barnes, Louisville, KY (US)

( * ) Notice: Subject to any disclaimer, the term of this patent is extended or adjusted under 35 U.S.C. 154(b) by 0 days.

(21) Appl. No.: 13/195,108

(22) Filed: Aug. 1, 2011

(65) Prior Publication Data

US 2012/0084897 A1 Apr. 12, 2012

Related U.S. Application Data

(60) Provisional application No. 61/390,843, filed on Oct. 7, 2010.

(51) Int. Cl.
*A41D 13/06* (2006.01)

(52) U.S. Cl.
USPC ..... 2/22; 36/2 R

(58) Field of Classification Search
USPC ..... 2/22, 24, 242, 455; 36/1.5, 2 A, 2 R
See application file for complete search history.

(56) References Cited

U.S. PATENT DOCUMENTS

| | | | | | |
|---|---|---|---|---|---|
| 1,678,566 | A * | 7/1928 | Gallant | 36/2 R |
| 1,955,487 | A * | 4/1934 | Cleofe | 36/2 R |
| 3,191,185 | A * | 6/1965 | Martin | 2/22 |
| 4,665,562 | A * | 5/1987 | Winer | 2/22 |
| 5,170,503 | A * | 12/1992 | Hightower et al. | 2/22 |
| 5,491,840 | A | 2/1996 | Yen | |
| 5,613,250 | A * | 3/1997 | Bell | 2/242 |
| 6,298,484 | B1 | 10/2001 | Beckman | |
| 2004/0088772 | A1 * | 5/2004 | Pollari | 2/22 |
| 2005/0114977 | A1 | 6/2005 | Bodnar | |
| 2009/0188133 | A1 | 7/2009 | Munns | |

* cited by examiner

*Primary Examiner* — Katherine Moran
(74) *Attorney, Agent, or Firm* — Daniel Boudwin

(57) ABSTRACT

The present invention provides a device for securing to the calf, shin and foot of a motorcycle user, to afford protection against heated exhaust parts and emissions therefrom. The device comprises a bi-layered material, with an aesthetically pleasing outer layer and thermally resistant inner layer. The device secures to the shin using adjustable elastic straps and securing snaps. The device features an optional ankle protector of the same bi-layered material attached to the bottom of the main bi-layered pad. Further, the optional ankle protector rolls up and secures into a stowed position to maintain maximum flexibility when not in use.

8 Claims, 2 Drawing Sheets

CALF AND ANKLE THERMAL PROTECTION DEVICE FOR MOTORCYCLISTS

CROSS REFERENCE TO RELATED APPLICATION

This application claims the benefit of U.S. Provisional Application No. 61/390,843 filed on Oct. 7, 2010, entitled "L.C. Guard."

BACKGROUND OF THE INVENTION

Field of the Invention

The present invention relates to a shin and foot thermal protection device. More particularly, a device is provided for protecting the shin, calf and foot from the heat of a motorcycle exhaust pipe, associated parts and emissions.

There is an ongoing need for motorcycle riders and passengers to protect themselves from burns caused by heat exposure to their skin. The location of motorcycle exhaust pipes place a rider and passenger's legs in close proximity to high temperature exhaust components and emitted exhaust. Therefore, there arises a need to protect a rider's lower extremities from these components and the heated exhaust that emanates therefrom. Without proper protection, the rider may be forced into a position that induces an uncomfortable ride, particularly during hot days or on longer rides wherein the exhaust components can conduct considerable heat. Painful burns and unsightly red marks can develop on motorcyclists' lower legs if unprotected. Excessive burns may result in injuries that require medical attention. Motorcyclists may employ items such as chaps, long pants or vented clothing to combat contact with and proximity to an exhaust during such rides. These solutions will work for short distances, but after a long period, a typical pant leg made of cotton or fabric will not provide an adequate barrier from the heat, and may even begin to deteriorate inferior protection and leg garments.

There exists a need in the art for a device that protects a motorcyclist's or motorcycle passenger's feet, shins and calves from the heated exhaust components of a bike. The present invention substantially fulfills this need with an easily deployable and removable interior ankle assembly that provides a thermal barrier and heat shield from these high temperature components, particularly during long rides wherein traditional fabric and garments do not afford sufficient thermal protection.

DESCRIPTION OF THE PRIOR ART

There exists in the prior art several patents granted and applications published that relate to protecting a user's legs from various injury. These prior art devices have known drawbacks and fail to address the issue of exhaust burns on the calves, shins and feet of motorcycle riders.

Some prior devices do provide any protection for a user's legs while motorcycle riding. Bodnar U.S. Patent Publication No. 2005/0114977 is directed to an improved way to protect the thigh of motorcycle riders from the heat of a motorcycle engine and the hot pavement of the road. The device prevents blisters by covering the rider's thigh with a flexible material in a predetermined shape. Further, the device includes straps to secure said invention to the human thigh and allows for easy adjustment and a custom fit for each rider. The device is lightweight for freedom of movement and easily removed when not needed. The Bodnar device requires no modification to the motorcycle, and is inexpensive. This patent serves a different purpose than the present invention; it addresses the issue of protecting the upper thigh area from heat generated by a motorcycle engine. The Bodnar device does not offer any protection to the lower extremities of a wearer from the high temperature exhaust components and gas therefrom.

Other devices are modifications to boots that dictate the footwear choice of a user. Munns U.S. Patent Publication No. 2009/0188133 is directed to protective footwear, such as a motorcycle or motocross boot, having a molded top gasket and/or a fold-over thermal laminate. The molded top gasket may be a substantially annular and unitary piece or of multi-piece construction comprising an elastomeric material that snugly wraps around the wearer's lower leg or ankle when wearing the footwear. The fold-over thermal laminate is a piece of thermally resistant material on the outer surface of the footwear upper that extends into the inside. The Munns invention is a boot that protects the lower leg from injury or burning while riding. The Munns invention is primarily directed to sport riding, as it does not allow the user to choose footwear based on style or ornamental taste, but rather provides a boot that serves a specific functionality. Casual riders will more likely choose a device that functions well with their current footwear. The present invention addresses this preference and serves to fulfill that need.

Other devices address physical impacts on the lower legs. Yen U.S. Pat. No. 5,491,840 is directed to a buffer structure improvement of a body part protector having a pad, and a board having a generally accurate cross-section with a string. Between the pad and the board is a buffer web attached to the board with buffer spacing between the web and the board. Similarly, Beckman U.S. Pat. No. 6,298,484 is directed to a protective guard intended for soccer players in which the participant wears the protective guard below the wearer's knees to protect the shins, calves, ankles and Achilles tendon from possible impact. The Yen and Beckman devices address the issue of a physical impact upon the lower leg, but do not address the issue of thermal protection.

Presently in the art, there is a need for a thermal protection device for the calf, shin and foot that may be used with any shoe or footwear, particularly one that is suited for motorcycle use wherein a user's lower legs are potentially exposed to the high temperature exhaust components of the same. The present invention substantially diverges in design elements from the prior art, consequently it is clear that there is a need in the art for an improvement to existing thermal leg garments for motorcycle use. In this regard the instant invention substantially fulfills these needs.

SUMMARY OF THE INVENTION

In view of the foregoing disadvantages inherent in the known types of leg thermal protective garments now present in the prior art, the present invention provides a new shin, calf and foot thermal protector garment wherein the same can be utilized for providing convenience for the user when riding motorcycles without risking burns due to contact or proximity to hot exhaust components or gas emanating therefrom.

The present invention is designed to prevent discomfort to motorcyclists' legs caused by engine exhaust heat and contact with components thereof. The device comprises a lightweight, heat-resistant covering designed to be worn along the inner surface of a rider's calf and ankle region. Each covering employs adjustable elastic straps with securing snaps, allowing users to achieve comfortable and secure fitment based on their leg sizes. The inner portion of the cover comprises a heat-resistant material for thermal resistance and added safety. When deployed, the device acts as a thermal shield that allows for complete freedom of leg movement by providing no constraints, yet fully protecting the rider from the heat generated from the exhaust and any incidental contact with nearby exhaust components. Using this product may prevent painful burns and injuries caused by contact with exhaust or stationing an ankle in close proximity to exhaust heat.

It is therefore an object of the present invention to provide a lightweight and inexpensive way to protect a motorcyclist's lower legs from heat generated by the exhaust gases, both through conduction of heat through the metallic components of the exhaust pipes, and the convection heat generated from the exiting exhaust. This invention is donned and removable as desired. It is designed to accommodate movement and flexure of the ankle joint, providing a flexible device that allows freedom of movement while riding or touring.

Another object of the present invention is to protect the rider without any modification to the motorcycle.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself, and manner in which it may be made and used, may be better understood by referring to the following description taken in connection with the accompanying drawings.

DETAILED DESCRIPTION OF THE INVENTION

Figure 1:
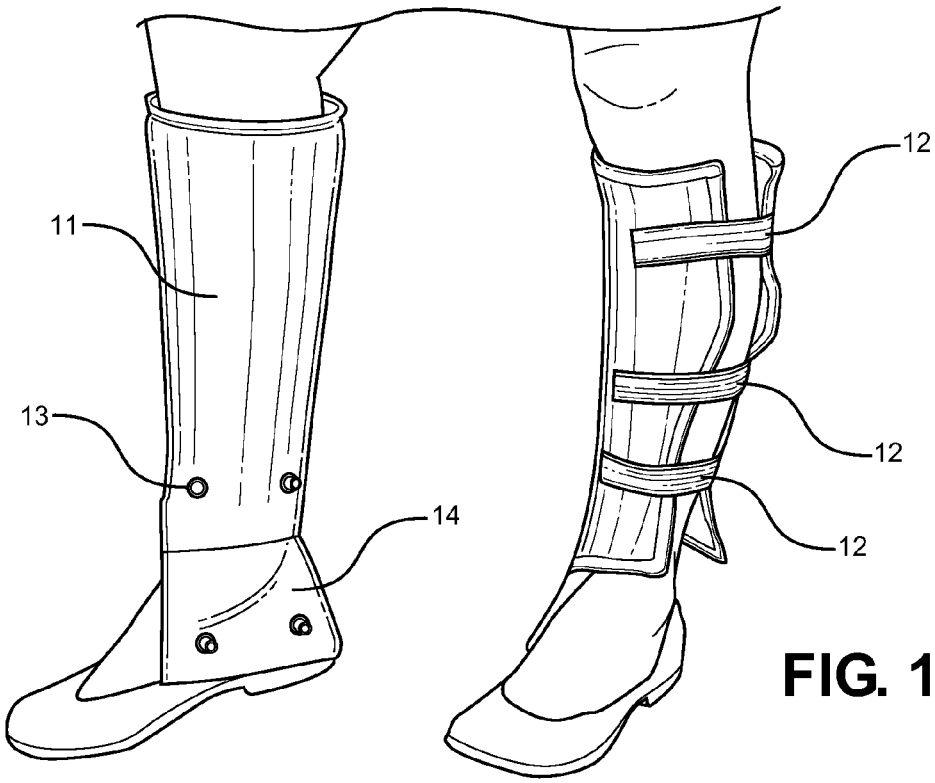
FIG. 1 is a perspective view of the present invention in its working position, attached to the inner surface of a wearer's calf and ankle and extending an deployable ankle guard.

Referring now to FIG. 1, there is shown a perspective view of the present invention in a working position with an ankle guard 14 extended. The calf guard 11 is secured to the shin of the user via adjustable elastic straps 12 and corresponding securing snaps 13. The inherent elasticity of the straps 12 provides fitment for varying sized calf sizes and leg sizes. The exact length of the calf guard 11 depends upon the user and the size chosen therefor. Its construction comprises a bi-layered material of outer fabric and an inner thermal protective layer. The outer fabric may be adorned with any ornamental features or designs as desired, while providing a material that is capable of withstanding considerably high temperatures and contact without burning, singing or igniting. The inner thermal layer provides the highest level of thermal resistance within the bi-layer sandwich construction, reducing heat transfer through the guard 11 when in proximity or contact with a heat source. The thermal layer is desirably comfortable to the touch, or alternatively may be sandwiched between two layers of comfortable fabric material that may also be moisture wicking. An extendable ankle guard 14 is provided to further protect the user along the ankle bond and any exposed region thereunder. It can be extended downward for additional coverage when deployed, or optionally stowed by connecting corresponding snaps to hold it in place.

Figure 2:
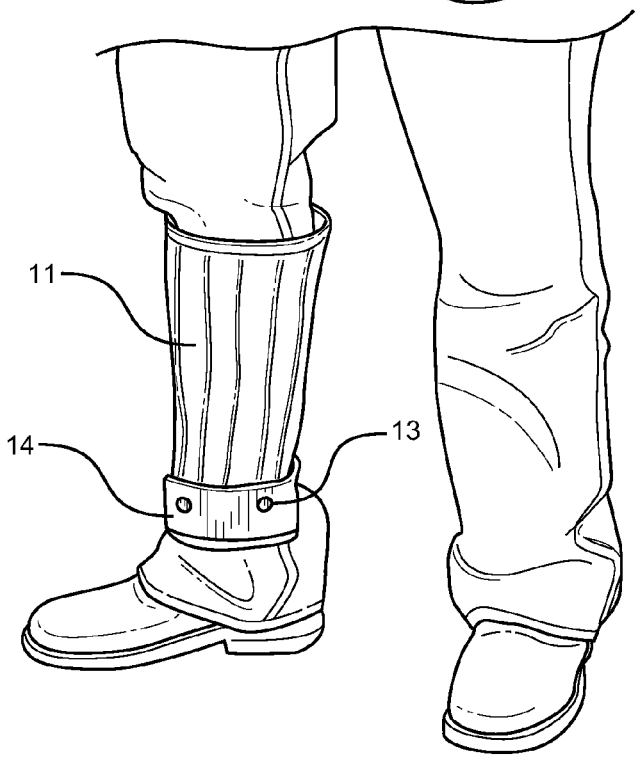
FIG. 2 is another perspective view of the present invention in its working position, attached to the inner surface of a wearer's calf and ankle and with a deployable ankle guard in a stowed position.

Referring now to FIG. 2, there is shown a perspective view of the present invention in a working position, wherein the ankle guard 14 is in a stowed position. The ankle guard 14 is secured for provide the user with maximum flexibility, but in turn limiting the thermal protective coverage area. The calf guard 11 is secured to the inner surface of the user's shin, making use of the adjustable elastic straps 12 and securing snaps 13. This figure illustrates an alternative configuration for the present invention while in use, providing thermal protection to the calf and lower leg, but terminating at the top of a user's boot and not covering any ankle or foot region.

Figure 3:
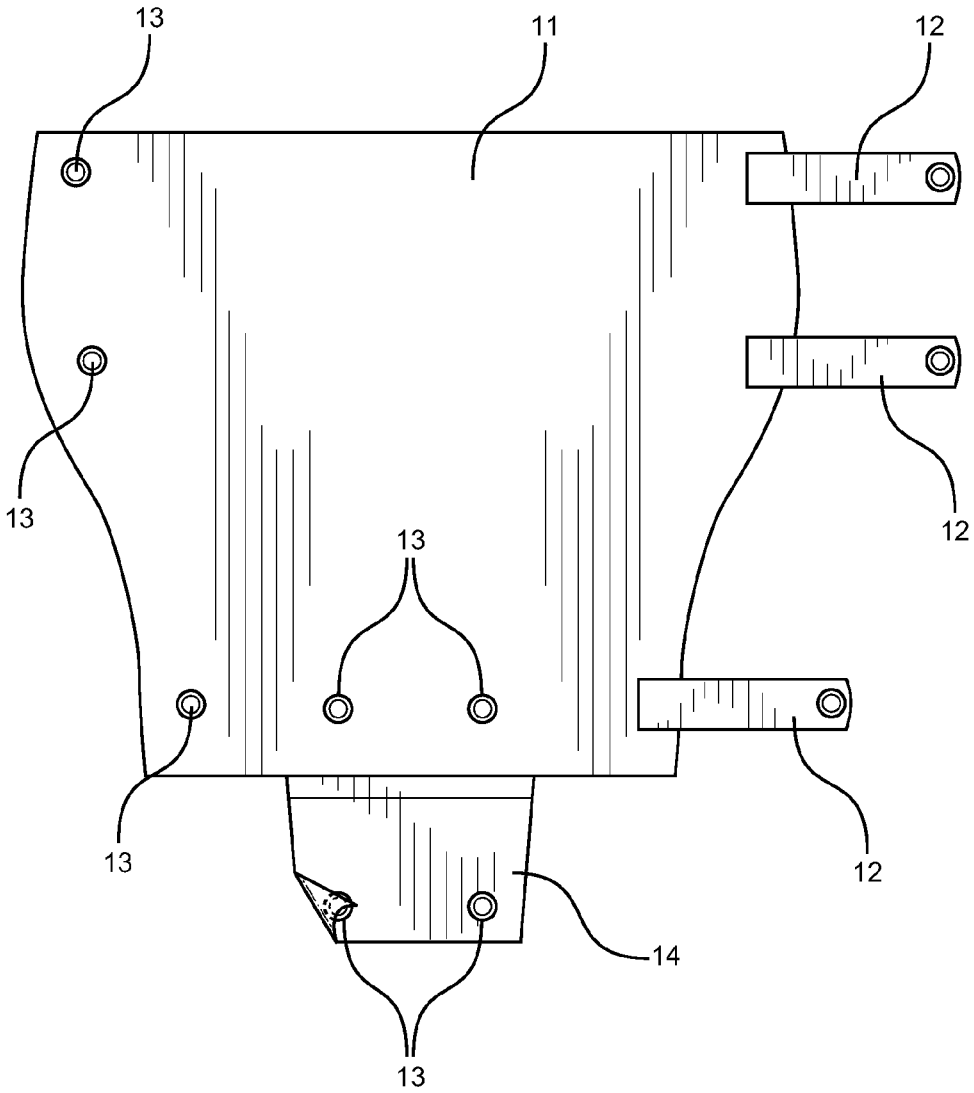
FIG. 3 is a planform view of the present device with the ankle guard attached and deployed.

Referring now to FIG. 3, there is shown a planform perspective view of the present device with the ankle guard 14 in a deployed position. The preferred hourglass shape of the calf guard 11 is shown in a flat position, with the adjustable elastic straps 12 and securing snaps 13 to either side. The ankle guard 14 is unrolled and extended downward. The shape of the calf guard 11 and the position of the straps 12 may vary depending upon the size and preferences of the end user. The bi-layer construction of the fabric positioned in parallel communication with the heat shield material is accomplished via a series of stitches that line the perimeter of the device, and likewise extend through the free field area of the calf guard to prevent bunching of material and facilitate bending, forming or conforming of the material around the shape of the user's calf. The straps may include adjustment slides to improve fitment, and the fabric material may likewise incorporate a stretch material to snuggly fit against the user when deployed. In an alternative embodiment, the heat resistant material may be sandwiched between an inside and outside layer of fabric, providing a surface to decorate on the outer surface, and a comfortable surface to contact the wearer on the inner surface.

The present invention provides consumers with a convenient and effective device for protecting their lower legs against burns caused by exhaust heat. The device may comprise a pair of coverings designed to fit around users' calves. The device comprises a calf guard 11 portion, connecting straps and a deployable ankle guard 14. The calf guard 11 is wider at its upper region and tapers in a curving manner to a shorter circumference bottom, corresponding to the changing radius of a typical user's leg from the calf region down to the ankle. The outside surfaces of the calf guard 11 and ankle guard 14 can be made of fabric, leather or another durable material, while the inside surface can be made of a quilted, heat-resistant material. The device may also include a series of adjustable elastic straps 12 and corresponding securing snaps 13 along its perimeter for securing the device to the leg of the wearer. The device may further include an ankle guard 14 of the same material that is deployable from the lower termination of the device. The ankle guard 14 may be stowed and secured to the leg coverings, or be deployed for use. The outer surface may be designed to accept designs and further outwardly facing ornamentation.

In use an individual wraps the calf guard 11 portion around the inner surface of their calf and secures the device in place with the adjustable elastic straps 12 and corresponding securing snaps 13. The elastic straps 12 secure such that they are facing outside of the practitioner's leg, away from the heat of the exhaust. Further, an ankle guard 14 may be unrolled downward to protect the ankle, foot and shoe for further protection. It may also be folded upward and secured for maximum flexibility when not in use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A thermal protection device for the lower leg and foot comprising:

a bi-layer calf guard with a fabric outer layer and a thermally protective inner layer;

and a plurality of adjustable elastic straps extending from a first side of said calf guard to a second side, said calf guard outer layer having a plurality of snaps positioned along its perimeter;

said elastic straps each having an end attached to said calf guard and a free end, said straps each having a snap at said free end for securing with outer layer snaps, thereby securing said device to a shin of a user;

said calf guard outer layer having a pair of snaps at a lower portion thereof;

an ankle guard formed of a fabric outer layer and a thermally protective inner layer, said ankle guard projecting downwardly from a lower termination of said calf guard, said ankle guard outer layer having a pair of snaps at each distal corner, said snaps adapted to connect to said pair of corresponding snaps disposed on said lower portion outer layer of said calf guard such that the ankle guard is adapted to fold upwardly over a lower portion of said calf guard when not in use;

said ankle guard adapted to fold downwardly in a deployed position for draping over an ankle bone and inner foot region of a user when in use.

2. A device as in claim 1, wherein said calf guard comprises an hour-glass shape, forming a larger radius upper termination and curving downward into a smaller radius lower termination.

3. A device as in claim 1, wherein said bi-layer material is stitched together along the perimeter of said calf guard and through a central portion thereof to facilitate forming to a user's leg.

4. The device of claim 1, wherein said ankle guard is rectangular.

5. A thermal protection device for the lower leg and foot comprising:

a calf guard with a first and second fabric outer layers sandwiching a thermally protective inner layer;

and a plurality of adjustable elastic straps extending from a first side of said calf guard to a second side, said calf guard outer layer having a plurality of snaps positioned along its perimeter;

said elastic straps each having an end attached to said calf guard and a free end, said straps each having a snap at said free end for securing with outer layer snaps, thereby securing said device to a shin of a user;

said calf guard outer layer having a pair of snaps at a lower portion thereof;

an ankle guard formed of a first and second fabric outer layers sandwiching a thermally protective inner layer, said ankle guard projecting downwardly from a lower termination of said calf guard, said ankle guard outer layer having a pair of snaps at each distal corner, said snaps adapted to connect to said pair of corresponding snaps disposed on said lower portion outer layer of said calf guard such that the ankle guard is adapted to fold upwardly over a lower portion of said calf guard when not in use;

said ankle guard adapted to fold downwardly in a deployed position for draping over an ankle bone and inner foot region of a user when in use.

6. A device as in claim 5, wherein said calf guard comprises an hour-glass shape, forming a larger radius upper termination and curving downward into a smaller radius lower termination.

7. A device as in claim 5, wherein said sandwich material is stitched together along the perimeter of said calf guard and through a central portion thereof to facilitate forming to a user's leg.

8. The device of claim 5, wherein said ankle guard is rectangular.

* * * * *